US011937749B1

(12) United States Patent
Afrouzi et al.

(10) Patent No.: US 11,937,749 B1
(45) Date of Patent: Mar. 26, 2024

(54) MOP ATTACHMENT FOR ROBOTIC SURFACE CLEANING DEVICES

(71) Applicants: Ali Ebrahimi Afrouzi, San Jose, CA (US); Soroush Mehrnia, Helsingborg (SE)

(72) Inventors: Ali Ebrahimi Afrouzi, San Jose, CA (US); Soroush Mehrnia, Helsingborg (SE)

(73) Assignee: AI Incorporated, Toronto (CA)

( * ) Notice: Subject to any disclaimer, the term of this patent is extended or adjusted under 35 U.S.C. 154(b) by 739 days.

(21) Appl. No.: 16/440,904

(22) Filed: Jun. 13, 2019

(51) Int. Cl.
*A47L 11/28* (2006.01)
*A47L 11/40* (2006.01)

(52) U.S. Cl.
CPC ..... *A47L 11/28* (2013.01); *A47L 11/4044* (2013.01); *A47L 11/4083* (2013.01); *A47L 2201/06* (2013.01)

(58) Field of Classification Search
CPC .. A47L 11/28; A47L 11/4044; A47L 11/4083; A47L 2201/06; A46B 11/0062; A46B 11/0079; A46B 11/0082
See application file for complete search history.

(56) References Cited

U.S. PATENT DOCUMENTS 6,158,081 A * 12/2000 Kasen ..... A47L 7/0038 15/320
6,741,054 B2 5/2004 Koselka
7,555,363 B2 6/2009 Augenbraun
7,779,505 B2 * 8/2010 Krebs ..... A47L 9/0613 15/328
7,870,637 B2 * 1/2011 Parr ..... A47L 5/32 15/327.2
8,392,021 B2 3/2013 Konandreas
8,516,651 B2 8/2013 Jones
8,739,355 B2 6/2014 Morse
8,774,970 B2 7/2014 Knopow
8,892,251 B1 11/2014 Dooley
8,898,844 B1 * 12/2014 Dooley ..... A47L 11/10 15/49.1
9,149,168 B2 10/2015 Baek
9,265,396 B1 * 2/2016 Lu ..... A47L 13/16
9,795,265 B2 * 10/2017 Hyun ..... A47L 11/4044
10,149,590 B2 * 12/2018 Jeong ..... A47L 11/4038
10,292,553 B1 * 5/2019 Ebrahimi Afrouzi ..... A47L 9/00
2006/0123587 A1 * 6/2006 Parr ..... A47L 11/34 15/320
2006/0288519 A1 * 12/2006 Jaworski ..... A47L 11/4036 15/340.1
2008/0140255 A1 * 6/2008 Ziegler ..... A47L 9/2852 15/4
2014/0130289 A1 * 5/2014 Hyun ..... A47L 11/145 15/319
2015/0128996 A1 * 5/2015 Dooley ..... A47L 11/4008 15/98
2015/0143646 A1 * 5/2015 Jeong ..... A47L 11/4038 15/98

* cited by examiner

*Primary Examiner* — Don M Anderson
*Assistant Examiner* — Jason Khalil Hawkins

(57) ABSTRACT

A removable mop attachment module, including a frame; a reservoir positioned within the frame; at least one drainage aperture positioned at a bottom of the reservoir; at least one breathing aperture positioned on the reservoir; and a pressure actuated valve positioned at least partially on an inner surface of the reservoir, covering the at least one breathing aperture.

19 Claims, 8 Drawing Sheets

MOP ATTACHMENT FOR ROBOTIC SURFACE CLEANING DEVICES

CROSS-REFERENCE TO RELATED APPLICATIONS

This application is a Continuation of Non-Provisional patent application Ser. No. 15/151,840, filed May 11, 2016, which claims the benefit of Provisional Patent Application No. 62/192,019, filed Jul. 13, 2015.

FIELD OF THE DISCLOSURE

This disclosure relates to robotic surface cleaning devices generally and, more particularly, to providing an attachment to robotic surface cleaning devices for facilitating mopping.

BACKGROUND

Robotic surface cleaning devices are being constantly improved to carry out tasks more thoroughly and efficiently. This is normally achieved by making improvements to their software and hardware. Also, changes can be made to different aspects of surface cleaning tasks that can be assigned to robotic surface cleaning devices, such as wet or dry floor cleaning or mopping.

Different types of floor cleaning functions for robotic surface cleaning devices have been disclosed in the prior art. For example, a surface dry cleaning robot that vacuums and brushes the area to remove dust and debris from the floor has been described in the prior art. A surface cleaning robot that uses cleaning fluids to scrub hard surfaces and a floor mopping robot that operates either autonomously or by remote control to drive around the workspace and mop the floor have also been described in the prior art. However, such surface cleaning devices of the prior art only have a single capability, requiring a combination of robots with different capabilities to accomplish both vacuuming and mopping, resulting in an increase in the cost of ownership, and maintenance as well as the net cleaning time of a given workspace.

There have been other attempts in the prior art to provide surface cleaning robots with mopping features. In some cases, the mopping feature is either provided by a dry cloth, which is installed under the robot's casing in order to wipe the floor while the robot moves around the workspace, or a wet mop feature, which has a cleaning liquid tank located within the robot's embodiment to dampen the cloth. In the latter scenario, the liquid inside the liquid tank flows onto the cloth at a constant rate without any control over the flow; therefore, the cleaning fluid doesn't last long and is inefficiently consumed. A need exists for a more efficient method for distributing fluid onto a mopping cloth.

SUMMARY

The following presents a simplified summary of some embodiments of the techniques described herein in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

In some embodiments, a removable mop attachment module is provided, including: a frame; a reservoir positioned within the frame; at least one drainage aperture positioned at a bottom of the reservoir; at least one breathing aperture positioned on the reservoir; and a pressure actuated valve positioned at least partially on an inner surface of the reservoir, covering the at least one breathing aperture, wherein: the pressure actuated valve opens from a closed position when an air pressure inside the reservoir reaches a predetermined amount of negative air pressure due to fluid flowing out of the reservoir through the at least one drainage aperture; the pressure actuated valve closes from an open position when the air pressure inside the reservoir increases to a predetermined amount due to air flowing into the reservoir through the at least one breathing aperture; and the opening and closing of the pressure actuated valve at least partially control the flow of fluid out of the reservoir through the at least one drainage aperture.

In other embodiments, a robotic cleaning device is provided, including: a casing; a chassis including a set of wheels; a motor to drive the wheels; a receiver for acquiring signals transmitted from a transmitting beacon; a processor for controlling the motor and cleaning operations of the robot; and a removable mop attachment module, comprising: a frame; a reservoir positioned within the frame; at least one drainage aperture positioned at a bottom of the reservoir; at least one breathing aperture positioned on an upper portion of the reservoir; and a pressure actuated valve positioned at least partially on an inner surface of the reservoir, covering the at least one breathing aperture, wherein: the pressure actuated valve opens from a closed position when an air pressure inside the reservoir reaches a predetermined amount of negative air pressure; the pressure actuated valve closes from an open position when the air pressure inside the reservoir increases to a predetermined amount; and the opening and closing of the pressure actuated valve at least partially control the flow of fluid out of the reservoir through the at least one drainage aperture; and wherein the removable mop attachment module is removable as a single unit from a body of the robotic cleaning device.

In yet other embodiments, a method for controlling a fluid flow from a reservoir, comprising: covering at least one breathing aperture of a reservoir containing fluid with a pressure actuated valve, wherein: the pressure actuated valve opens from a closed position when a first air pressure inside the reservoir decreases to a first level as a result of fluid flowing out of one or more drainage apertures positioned on a bottom of the reservoir; and the pressure actuated valve closes from an open position when the first air pressure inside the reservoir increases to a second level as a result of air flowing into the reservoir through the at least one breathing aperture, and draining fluid through the one or more drainage apertures on which one or more flow reduction valves are positioned, wherein: the fluid flow through the one or more flow reduction valves and corresponding one or more drainage apertures is at least partially controlled by the opening and closing of the pressure actuated valve; and the one or more flow reduction valves comprises a fluid passage through which the fluid flows prior to reaching the one or more drainage apertures.

DETAILED DESCRIPTION OF SOME EMBODIMENTS

Figure 1:
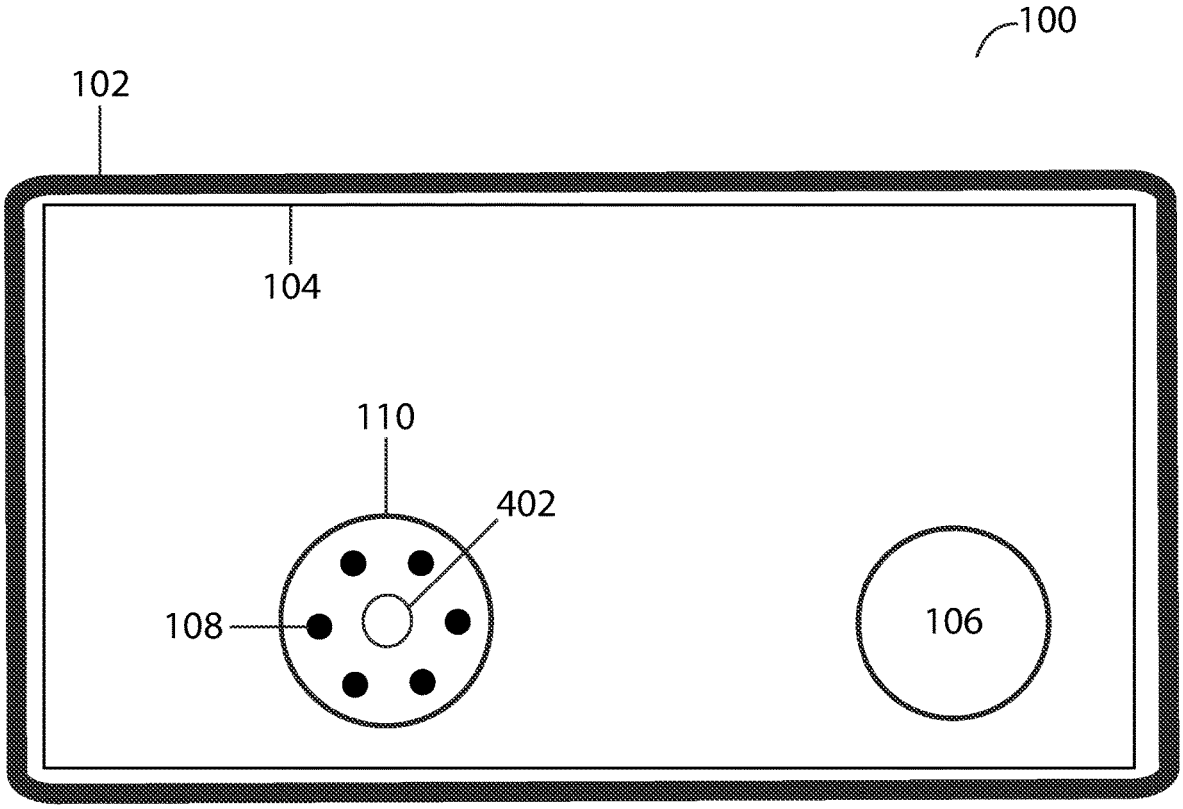
FIG. 1 illustrates an overhead view of a removable mop attachment module, according to some embodiments.

The present invention will now be described in detail with reference to a few embodiments thereof as illustrated in the accompanying drawings. In the following description, numerous specific details are set forth in order to provide a thorough understanding of the present inventions. It will be apparent, however, to one skilled in the art, that the present invention may be practiced without some or all of these specific details. In other instances, well known process steps and/or structures have not been described in detail in order to not unnecessarily obscure the present invention. Further, it should be emphasized that several inventive techniques are described, and embodiments are not limited to systems implanting all of those techniques, as various cost and engineering trade-offs may warrant systems that only afford a subset of the benefits described herein or that will be apparent to one of ordinary skill in the art.

Various embodiments are described hereinbelow, including methods and techniques. It should be kept in mind that the invention might also cover articles of manufacture that includes a computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out tasks pertaining to embodiments of the invention. Examples of such apparatus include a specialized computer and/or a dedicated computing device when appropriately programmed and may include a combination of a computer/computing device and dedicated/programmable circuits adapted for the various tasks pertaining to embodiments of the invention. The disclosure described herein is directed generally to a robotic surface cleaning device having a mopping capability.

As understood herein, the term "robot" or "robotic device" may be defined generally to include one or more autonomous or semi-autonomous devices having communication, mobility, and/or processing elements. For example, a robot or robotic device may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., and one or more clock or synchronizing devices.

Embodiments include a mop attachment having a passive liquid (or fluid) flow pace control using a pressure actuated valve, for use in robotic surface cleaning devices in order to provide mopping functionality to a robotic surface cleaning device.

Embodiments disclose a robotic surface cleaning device including a casing; a chassis including a set of wheels; a motor to drive the set of wheels; and a removable mop attachment module.

In some embodiments, the removable mop attachment module includes a frame; a reservoir positioned within the frame, one or more drainage apertures positioned on the bottom of the removable mop attachment module that allow liquid to flow out of the reservoir; a breathing aperture, which may allow air into the reservoir, positioned on an upper portion (or on another location in some cases) of the reservoir, and a pressure actuated valve positioned on an inner surface of the reservoir and under the breathing aperture(s), sealing the reservoir while in a closed position and opening when a certain amount of negative air pressure has built up inside the reservoir due to the draining of liquid, letting some air inside the reservoir through the breathing aperture(s).

In some embodiments, the pressure actuated valve includes a valve body, adapted for mounting on at least an air passage; a valve member connected to the valve body having at least a flexible element moveable relative to the valve body that forms a seal on the air passage when in a closed position, wherein a certain pressure difference between the two sides of the valve member moves the flexible element from the closed position to an open position letting air enter the air passage.

It will be obvious to one skilled in the art that the pressure actuated valve may function with various fluids capable of creating a negative pressure behind the valve and opening the valve.

FIG. 1 illustrates an overhead view of a removable mopping attachment 100 used in some embodiments. A frame 102 houses a reservoir 104 in which cleaning liquid may be stored. The reservoir 104 has an opening 106 for refilling cleaning liquid, which will be sealed by a lid 107. A series of apertures 108 as air breathing inlets are positioned on an upper portion of the reservoir. A pressure actuated valve 110 is mounted under the air breathing inlets and seals the reservoir 104 from inside when it is in a closed position. A valve body, member 402, is a part of the valve 110, discussed below.

Figure 2:
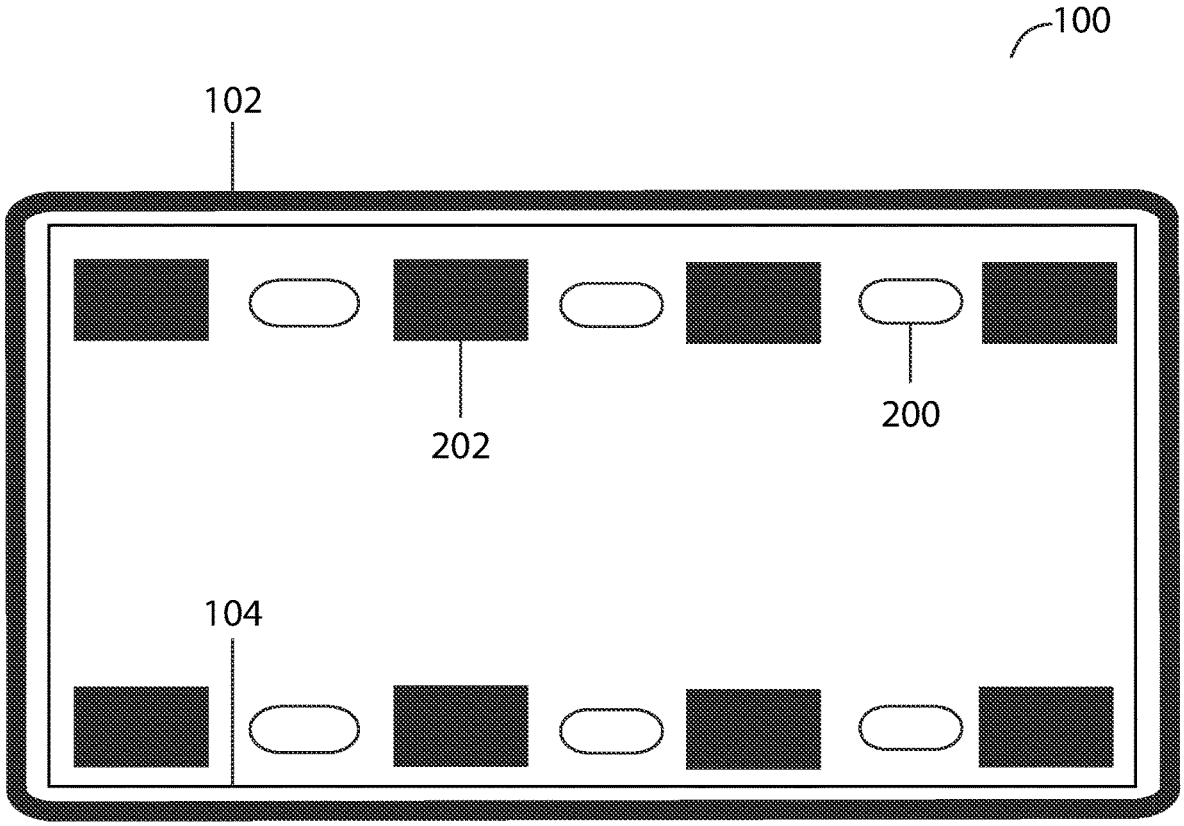
FIG. 2 illustrates a bottom view of the removable mop attachment module, according to some embodiments.

FIG. 2 illustrates a bottom view of the mopping attachment 100. On the bottom of the frame 102, liquid drainage apertures 202 let the cleaning liquid out of the reservoir 104 and dampen a mopping cloth (not shown) that may be attached to the underside of the mopping extension 100 via attaching devices 200.

It will be obvious to one skilled in the art that the attaching devices 200 for attaching the mop cloth could be one of many of the known attachment mechanisms in the art such as Velcro™, magnets, snap fasteners, or a simple cloth grabbing mechanism.

Figure 3:
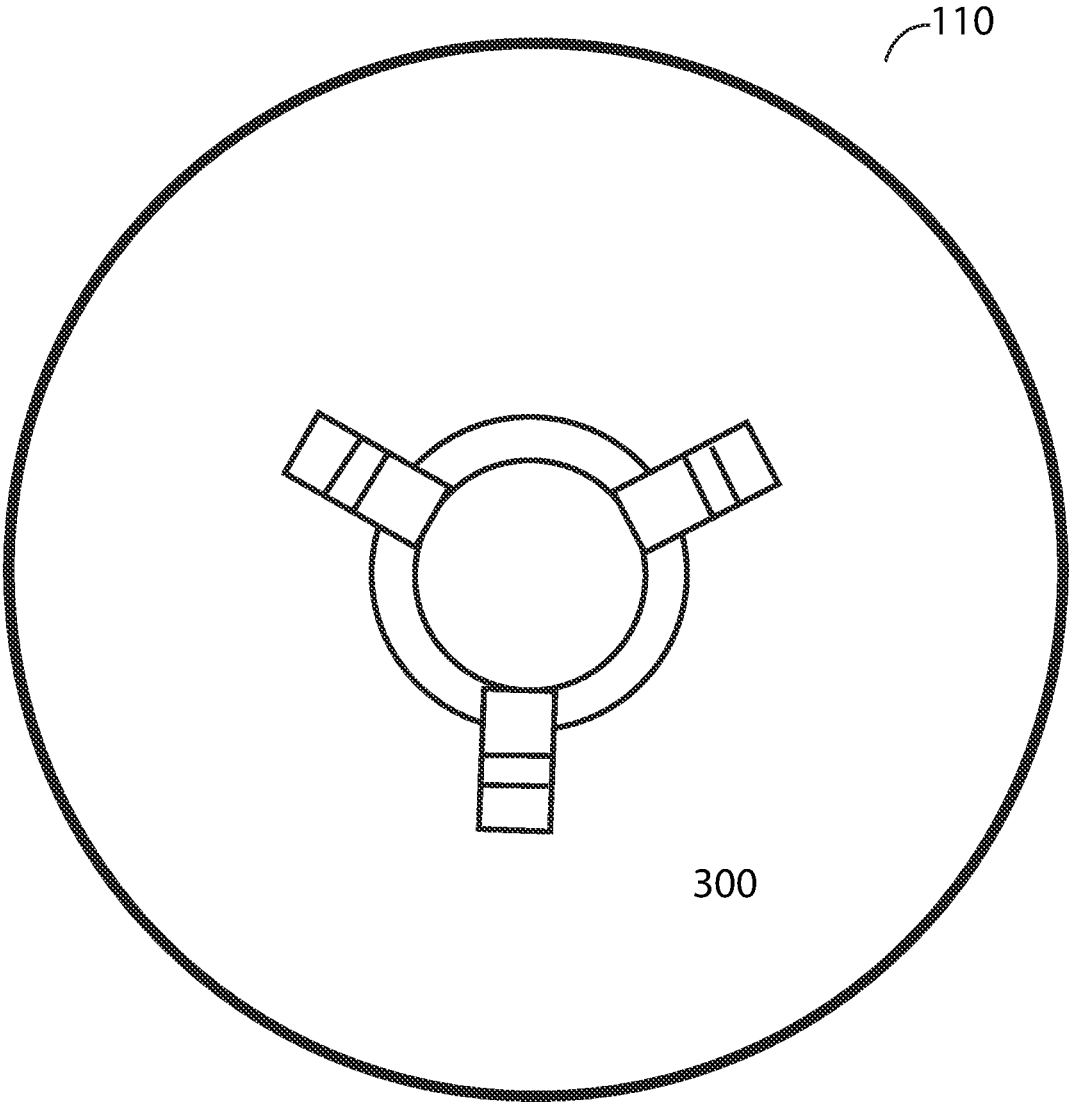
FIG. 3 illustrates an overhead view of a pressure actuated valve, according to some embodiments.

FIG. 3 illustrates an overhead view of the pressure actuated valve 110, according to some embodiments. The pressure actuated valve 110 has a flexible valve member 300, which seals the reservoir and stops air from entering the reservoir through the breathing inlets illustrated in FIG. 1.

It will be obvious to one skilled in the art that the flexible valve member 300 could be made of various flexible materials, such as, but not limited to, silicon, rubber, or plastic.

Figure 4:
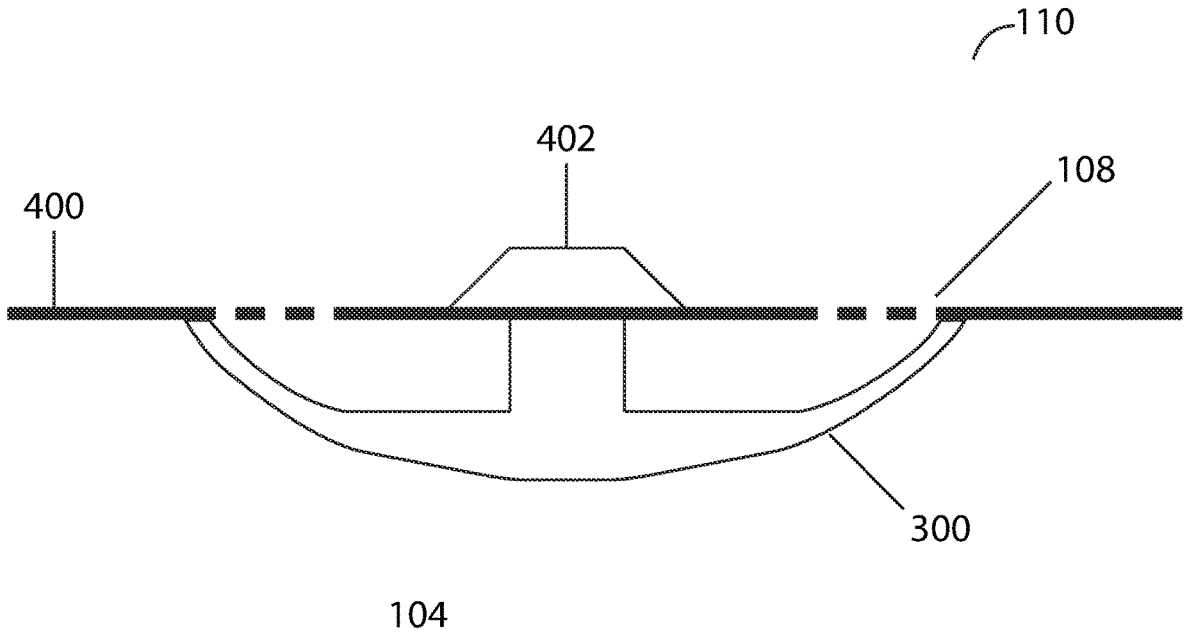
FIG. 4 illustrates a cross sectional view of the pressure actuated valve in a closed position, according to some embodiments.

FIG. 4 illustrates a cross sectional view of the pressure actuated valve 110 installed on an inner surface of a side 400 of the reservoir 104. In the example illustrated, the pressure actuated valve is in a closed position. The pressure actuated valve 110 is mounted inside the reservoir 104 using the valve body, a member 402, in a way that it seals the reservoir 104.

When the reservoir 104 is sealed and the liquid inside the reservoir 104 drains through the drainage apertures 202 (shown in FIG. 2), a negative pressure builds up inside the reservoir 104. When the negative pressure gets high enough, the pressure difference between a first and a second side of the valve 110 moves flexible valve member 300 from a closed position to an open position, wherein flexible valve member 300 is drawn away from the side 400 of the reservoir. This allows some air into the reservoir through the intake apertures 108, which increases the air pressure inside the reservoir 104, allowing liquid to drain from the drainage apertures once again.

Figure 5:
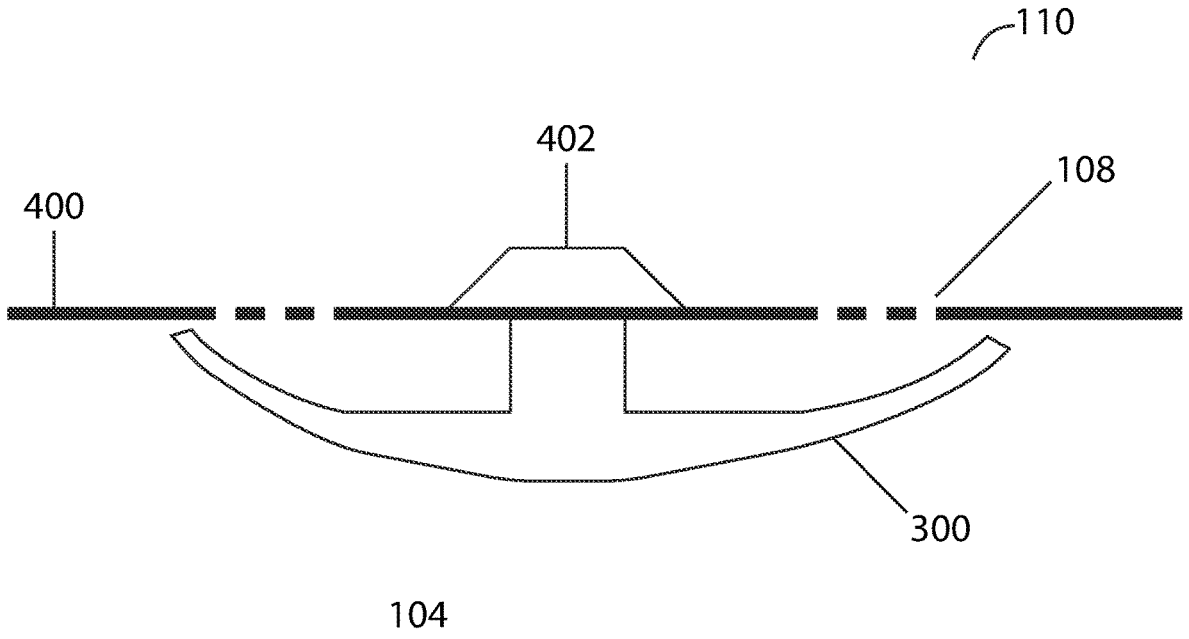
FIG. 5 illustrates a cross sectional view of the pressure actuated valve in an open position, according to some embodiments.

FIG. 5 shows a cross sectional view of the pressure actuated valve 108 in an open position. As illustrated, upon reaching a certain amount of negative pressure within the reservoir 104, the flexible valve member 300 is drawn away from the side 400 of the reservoir 104 by the built up negative pressure, unblocking the intake apertures 108, which lets air momentarily inside the reservoir 104 until the negative pressure has equalized enough to cause the flexible valve member 300 to return to the closed position.

It will be obvious to one skilled in the art that the pressure actuated valve 110 could be installed on the top or side or another location on the reservoir. In embodiments, the pressure actuated valve is installed higher than the reservoir's maximum allowable liquid level.

It will be obvious to one skilled in the art that the member 402 may be mounted on the reservoir 104 using various known mechanism in the art.

Figure 6:
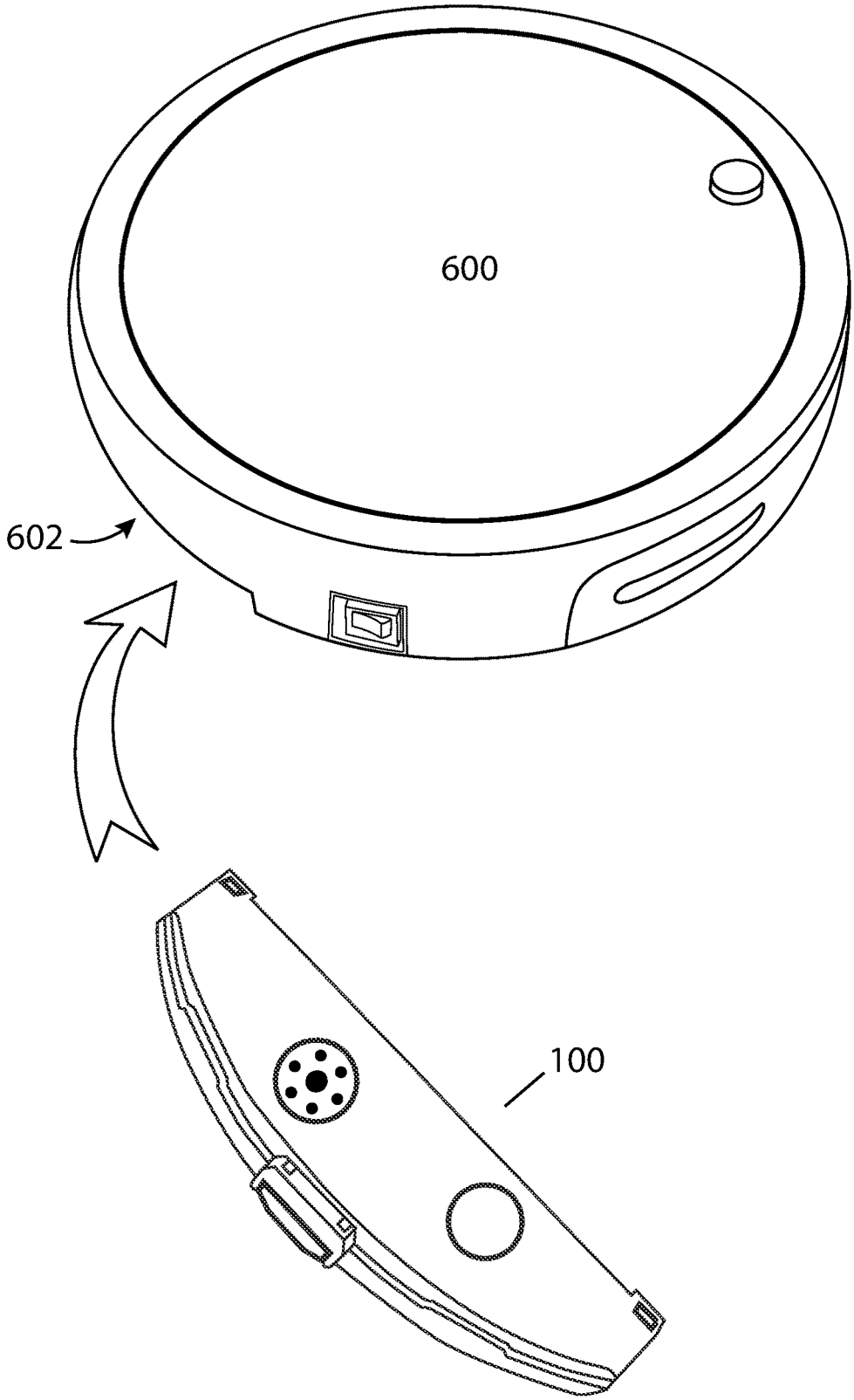
FIG. 6 illustrates a perspective view of the removable mop attachment and its housing in a robotic surface cleaning device, according to some embodiments.

FIG. 6 illustrates a perspective view of an example of a removable mopping attachment 100 and how it may be attached to or removed from a robotic surface cleaning device 600. The robotic surface cleaning device 600 has a slot 602 on the underside thereof for receiving the mopping attachment. The mopping attachment 100 may be installed within the slot 602 such that the mopping cloth (not shown) on the bottom of the mopping attachment 100 is in contact with the work surface.

Figure 7:
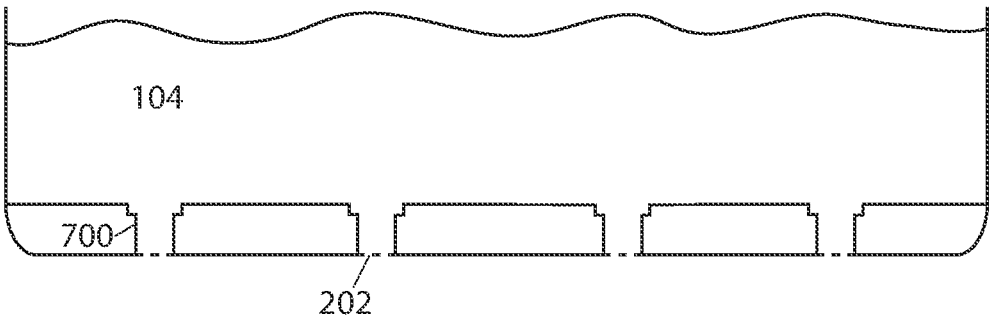
FIG. 7 illustrates flow reduction valves positioned on the drainage apertures to reduce the flow of liquid from the reservoir, according to some embodiments.

In some embodiments, the drainage apertures may further include a flow reduction valve positioned on the drainage apertures to reduce the flow of liquid from the reservoir. FIG. 7 illustrates an example of flow reduction valves 700 positioned on drainage apertures 202 to reduce the flow of liquid from reservoir 104, according to some embodiments.

Figure 8:
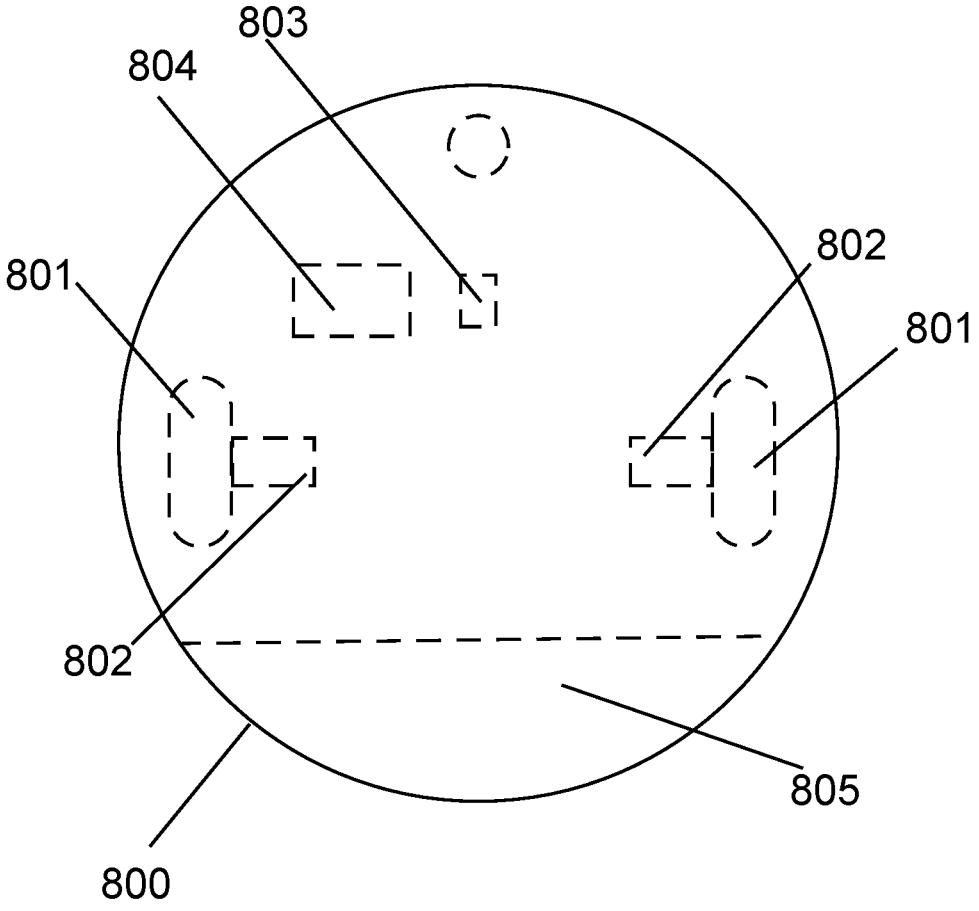
FIG. 8 illustrates an example a robot according to some embodiments.

FIG. 8 illustrates an example of a robot including a chassis 800, a set of wheels 801, motors 802 to drive the wheels 801, a processor 803, a signal receiver 804, and a mopping attachment module 805.

In block diagrams, illustrated components are depicted as discrete functional blocks, but embodiments are not limited to systems in which the functionality described herein is organized as illustrated. The functionality provided by each of the components may be provided by specialized software or specially designed hardware modules that are differently organized than is presently depicted; for example, such software or hardware may be intermingled, conjoined, replicated, broken up, distributed (e.g. within a data center or geographically), or otherwise differently organized. The functionality described herein may be provided by one or more processors of one or more computers executing specialized code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information conveyed over networks, in which case, to the extent information (e.g., content) is said to be supplied or otherwise provided, the information may be provided by sending instructions to retrieve that information from a content delivery network.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the"

include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X' ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation.

The invention claimed is:

1. A removable mop attachment module, comprising:

a reservoir;

an opening disposed on a top surface of the reservoir for filling the reservoir with a fluid;

a lid for sealing the opening;

at least one drainage aperture positioned on a bottom surface of the reservoir;

at least one breathing aperture positioned on a top surface of the reservoir;

a mopping cloth positioned on the bottom surface of the reservoir to receive fluid drained from the at least one drainage aperture;

a means for holding the mopping cloth to the bottom surface of the reservoir; and a pressure actuated valve mounted on the top surface of the reservoir and positioned at least partially inside the reservoir, covering the at least one breathing aperture, wherein:

the pressure actuated valve opens from a closed position when an air pressure inside the reservoir reaches a predetermined amount of negative air pressure due to the fluid flowing out of the reservoir through the at least one drainage aperture;

the pressure actuated valve closes from an open position when the air pressure inside the reservoir increases to a predetermined amount due to air flowing into the reservoir through the at least one breathing aperture; and the opening and closing of the pressure actuated valve at least partially control the flow of the fluid out of the reservoir through the at least one drainage aperture.

2. The removable mop attachment module of claim 1, further comprising a flow reduction valve positioned on the at least one drainage aperture.

3. The removable mop attachment module of claim 1, wherein the means for holding the mopping cloth to the bottom surface of the reservoir comprises hooks and loops.

4. The removable mop attachment module of claim 1, wherein the pressure actuated valve further comprises:

a valve body adapted for mounting on the top surface of the reservoir and positioned at least partially external to the reservoir; and a valve member connected to the valve body having at least a flexible element disposed inside the reservoir moveable relative to the valve body that forms a seal on the at least one breathing aperture when in a closed position, wherein a pressure difference between a first and a second side of the valve member moves the flexible element from the closed position to an open position and wherein the flexible element returns to the closed position when the pressure has equalized.

5. The removable mop attachment module of claim 4, wherein the flexible element is made from any of: silicon, rubber, or plastic.

6. The removable mop attachment module of claim 1, wherein the removable mop attachment module is removable as a single unit from a body of a robotic cleaning device.

7. The removable mop attachment module of claim 6, wherein the frame is adapted to slide into one or more slots on a rear portion of the body of the robotic cleaning device.

8. A robotic cleaning device comprising:
a chassis including a set of wheels;
a motor to drive the wheels;
a receiver for acquiring signals;
a processor for controlling the motor and cleaning operations of the robot; and
a removable mop attachment module, comprising:
a reservoir;
an opening disposed on a top surface of the reservoir for filling the reservoir with a fluid;
a lid for sealing the opening;
at least one drainage aperture positioned on a bottom surface of the reservoir;
at least one breathing aperture positioned on a top surface of the reservoir;
a mopping cloth positioned on the bottom surface of the reservoir to directly receive fluid drained from the at least one drainage aperture;
a means for holding the mopping cloth to the bottom surface of the reservoir; and
a pressure actuated valve mounted on the top surface of the reservoir and positioned at least partially inside the reservoir, covering the at least one breathing aperture,
wherein:
the pressure actuated valve opens from a closed position when an air pressure inside the reservoir reaches a predetermined amount of negative air pressure;
the pressure actuated valve closes from an open position when the air pressure inside the reservoir increases to a predetermined amount; and
the opening and closing of the pressure actuated valve at least partially control the flow of the fluid out of the reservoir through the at least one drainage aperture; and
wherein the removable mop attachment module is removable as a single unit from a body of the robotic cleaning device.

9. The robotic cleaning device of claim 8, further comprising a flow reduction valve positioned on the at least one drainage aperture.

10. The robotic cleaning device of claim 8, wherein the pressure actuated valve further comprises:
a valve body adapted for mounting on the top surface of the reservoir and positioned at least partially external to the reservoir; and
a valve member connected to the valve body having at least a flexible element disposed inside the reservoir moveable relative to the valve body that forms a seal on the at least one breathing aperture when in a closed position,
wherein a pressure difference between a first and a second side of the valve member moves the flexible element from the closed position to an open position, and wherein the flexible element returns to the closed position when the pressure has equalized.

11. The robotic cleaning device of claim 8, wherein the reservoir is adapted to slide into one or more slots on a rear portion of the body of the robotic cleaning device.

12. A method for controlling a fluid flow from a reservoir, comprising:
covering at least one breathing aperture positioned on a top surface of a reservoir containing fluid with a pressure actuated valve, wherein:
the reservoir comprises an opening disposed on a top surface of the reservoir for filling the reservoir with a fluid;
the reservoir further comprises a lid for sealing the opening;
the pressure actuated valve is mounted on the top surface of the reservoir and positioned at least partially inside the reservoir, covering the at least one breathing aperture;
the pressure actuated valve opens from a closed position when a first air pressure inside the reservoir decreases to a first level as a result of the fluid flowing out of one or more drainage apertures positioned on a bottom surface of the reservoir; and
the pressure actuated valve closes from an open position when the first air pressure inside the reservoir increases to a second level as a result of air flowing into the reservoir through the at least one breathing aperture;
draining fluid through the one or more drainage apertures on which one or more flow reduction valves are positioned, wherein:
the fluid flow through the one or more flow reduction valves and corresponding one or more drainage apertures is at least partially controlled by the opening and closing of the pressure actuated valve; and
the one or more flow reduction valves comprises a fluid passage through which the fluid flows prior to reaching the one or more drainage apertures; and
attaching a mopping cloth to the bottom surface of the reservoir to directly receive the fluid drained from the one or more drainage apertures, wherein:
the reservoir comprises a means for holding the mopping cloth to the bottom surface of the reservoir.

13. The method of claim 12, wherein the pressure actuated valve further comprises:
a valve body adapted for mounting on the top surface of the reservoir and positioned at least partially external to the reservoir; and
a valve member connected to the valve body having at least a flexible element disposed inside the reservoir moveable relative to the valve body that forms a seal on the at least one breathing aperture when in a closed position,
wherein a pressure difference between a first and a second side of the valve member moves the flexible element from the closed position to an open position, and wherein the flexible element returns to the closed position when the pressure has equalized.

14. The method of claim 12, wherein the reservoir with the pressure actuated valve, one or more drainage apertures, and corresponding one or more flow reduction valves is removable as a single unit from a body of a robotic cleaning device.

15. The method of claim 14, further comprising installing the reservoir on the body of the robotic cleaning device by sliding the reservoir into one or more slots on a rear portion of the body of the robotic cleaning device.

16. The method of claim 12, wherein the pressure actuated valve is at least partially fabricated from one or more of: silicon, rubber, or plastic.

17. The removable mop attachment module of claim 7, wherein the robotic cleaning device is configured to mop and vacuum.

18. The robotic cleaning device of claim 11, wherein the robotic cleaning device is configured to mop and vacuum.

19. The method of claim 15, wherein the robotic cleaning device is configured to mop and vacuum.

* * * * *